United States Patent [19]

Moore

[11] Patent Number: 5,048,444

[45] Date of Patent: Sep. 17, 1991

[54] ADJUSTABLE WHEEL FOR YACHT PEDESTAL STEERER

[76] Inventor: John E. Moore, 265 Grandview Dr., Warwick, R.I. 02886

[21] Appl. No.: 494,595

[22] Filed: Mar. 16, 1990

Related U.S. Application Data

[63] Continuation-in-part of Ser. No. 295,908, Jan. 11, 1989, abandoned.

[51] Int. Cl.[5] ..... B63H 25/02

[52] U.S. Cl. ..... 114/144 R; 74/493

[58] Field of Search ..... 74/469, 480 B, 491–493, 74/510, 511 R; 114/144 R, 270, 154–161, 170–172; 180/78, 79; 280/771, 775, 777, 779, 780

[56] References Cited

U.S. PATENT DOCUMENTS

| | | | |
|---|---|---|---|
| 95,278 | 9/1869 | Skinner | 114/154 |
| 881,324 | 3/1908 | Lowell | 114/172 |
| 2,826,090 | 3/1958 | Grinnell | 74/493 |
| 3,487,712 | 1/1970 | Steiner | 74/493 |
| 3,559,611 | 2/1971 | Cushman | 114/270 |
| 4,040,375 | 9/1977 | Askins | 114/160 |
| 4,470,363 | 9/1984 | Kalayjian | 114/160 |
| 4,726,311 | 2/1988 | Niina | 74/493 |
| 4,744,323 | 5/1988 | Perini | 114/144 R |

*Primary Examiner*—Joseph F. Peters, Jr.
*Assistant Examiner*—Clifford T. Bartz
*Attorney, Agent, or Firm*—Barlow & Barlow, Ltd.

[57] ABSTRACT

A shaft for a yacht steering pedestal has a swivel between the pedestal outer bearing and the steering wheel. The swivel permits the wheel to be rocked from a normal athwartships position to an angular position alongside the pedestal and thereby gain walking freedom in the cockpit of a sailing vessel.

5 Claims, 2 Drawing Sheets

ADJUSTABLE WHEEL FOR YACHT PEDESTAL STEERER

CROSS REFERENCE TO RELATED APPLICATION

This application is a continuation in part of my application Ser. No. 07/295,908, filed Jan. 11, 1989, now abandoned.

BACKGROUND OF THE INVENTION

Some boats are open and roomy with considerable area in the cockpit while other boats are the exact opposite. Many smaller boats are fitted with tiller steering control and there is a desire on the part of many boat owners to convert the tiller steering control to pedestal steering. In boats which are crowded, it is difficult to choose the proper location of the pedestal steerer for it is often found that the wheel interferes with the opening of cockpit seats that hinge upwardly and generally outboard and thus conversion to a pedestal steerer is considered impossible. There are also boats with existing pedestal steering with large diameter wheels to permit one to sail from the weather or lee rail as desired. These installation make it virtually impossible to pass by the wheel going aft or forward in the cockpit.

In the prior art there is very little suggestion of adjustable wheels although in the Loeffler patent, U.S. Pat. No. 2,926,545, there is suggested a bulkhead mounting in which the steering shaft may be made adjustable to a variety of positions. In the automotive field, of course, there are moveable steering columns. In an example of such device is seen in the Sippel patent, U.S. Pat. No. 3,487,711.

SUMMARY OF THE INVENTION

A steering pedestal for a yacht is fitted with a steering shaft which has a swivel between the pedestal and the wheel which swivel has spring loaded plungers that permit the stub shaft upon which the wheel is mounted to be located in at least three positions. The shaft is intended to be a replacement for a standard shaft furnished on a steering pedestal and may be readily placed into an existing pedestal by merely loosing set screws on the retaining collars on the existing shaft, holding the chain sprocket in position, withdrawing the shaft and replacing it with a shaft of the invention. In certain pedestal constructions, only a swivel and a stub wheel shaft are provided. In use, the wheel is adjusted so that the swivel is horizontal and in this position, the plunger may be withdrawn and the wheel rocked to the left or the right as desired so that the same will lie somewhat alongside of the pedestal leaving full clearance to move about at least on one side of the cockpit now left free of obstructions.

DESCRIPTION OF THE PREFERRED EMBODIMENT

Figure 1:
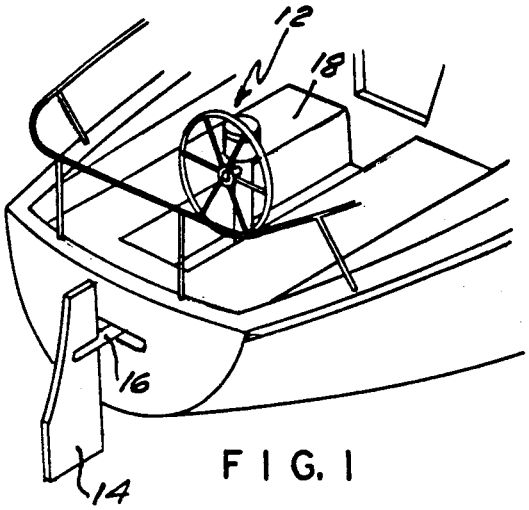
FIG. 1 is a perspective view of the stern of a small boat illustrating a standard steering pedestal mounted therein.

With reference to FIG. 1, a pedestal steerer 12 is illustrated in the cockpit of a small boat which is fitted with an outboard rudder 14 that has affixed thereto an outboard rudder quadrant 16 which is connected either by push-pull cables or with flexible cable to the quadrant. Cockpits of this nature often have cockpit seats with covers 18 that hinge upwardly. While it is perfectly permissible to find room to lift a seat such as 18 with tiller attached to the rudder, it is not so feasible when a pedestal steerer is installed in the boat. As seen more particularly in FIG. 2, it can be appreciated that the pedestal with the wheel 13 attached prohibits the lifting of a cover such a 18. For this reason, it is generally found undesirable to install pedestal steerers in some small boats.

Figure 5:
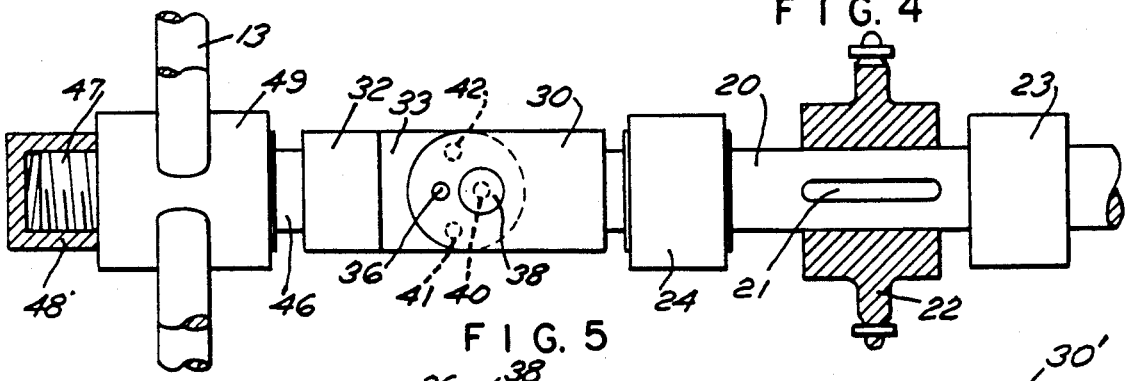
FIG. 5 is a plan view, partly in section, of the replacement shaft made in accordance with the invention.
Figure 6:
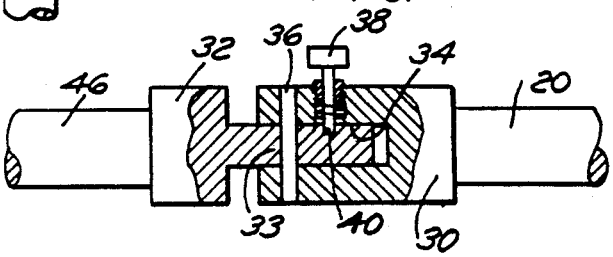
FIG. 6 is a view of the swivel, partly in section, illustrating a retractable plunger locking pin.
Figure 7:
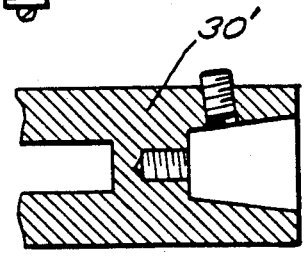
FIG. 7 is a sectional view of a female swivel part for a rack and pinion pedestal steerer.
Figure 8:
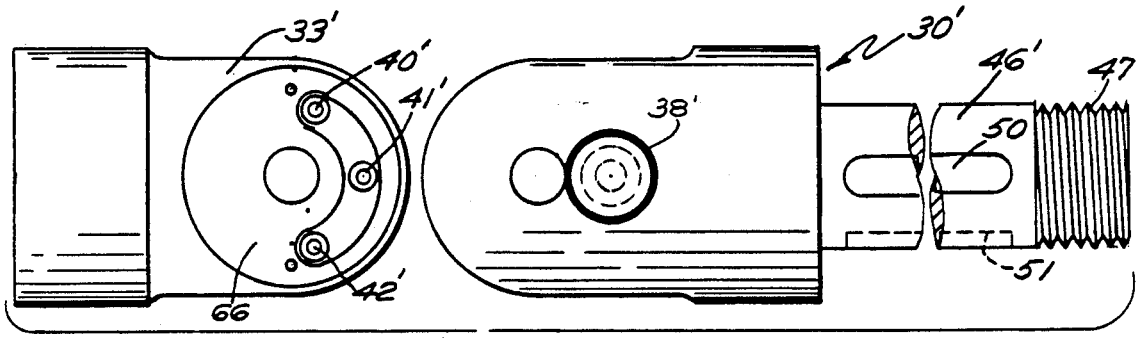
FIG. 8 is a detached enlarged top plan view of a preferred form of the swivel joint.
Figure 9:
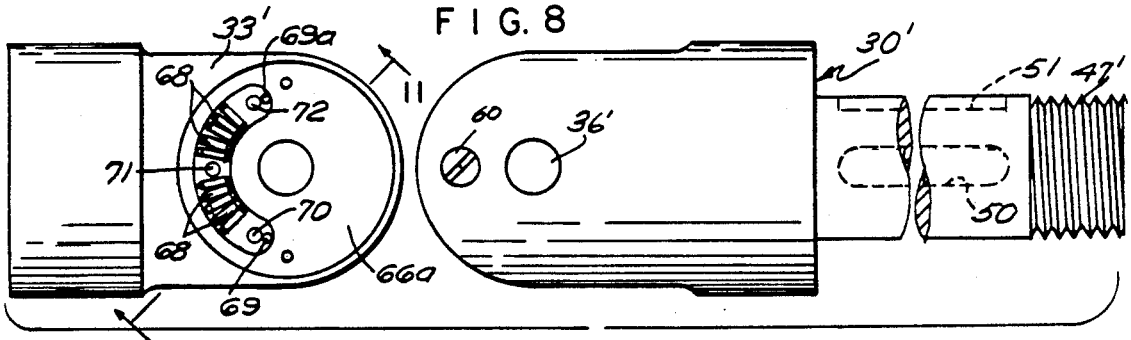
FIG. 9 is a bottom view thereof.
Figure 10:
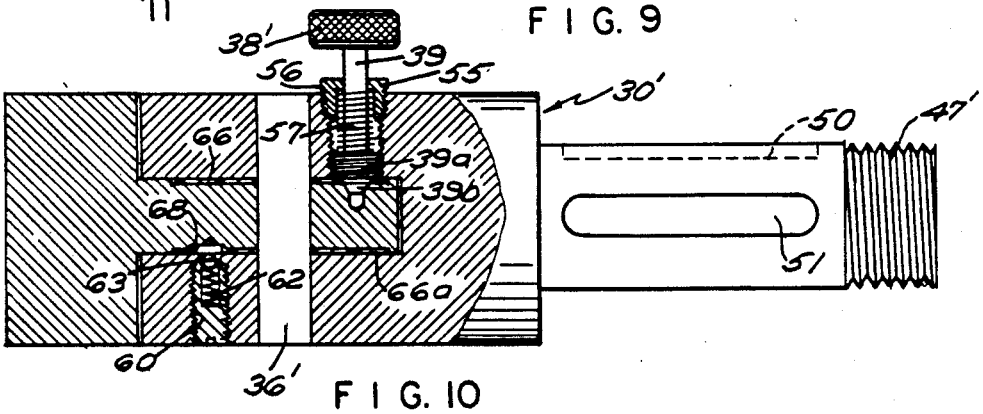
FIG. 10 is a central sectional view.
Figure 11:
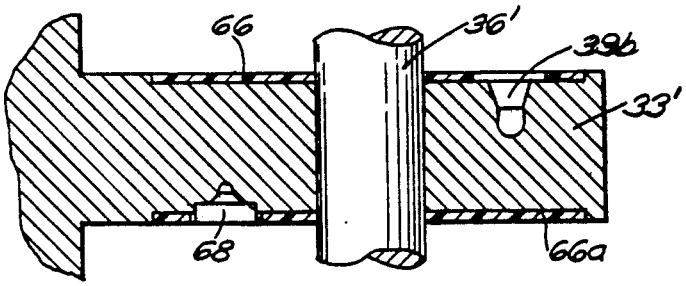
FIG. 11 is a sectional view taken on lines 11—11 of FIG. 9.

To alleviate the problem, a replacement shaft for a standard pedestal is provided which is illustrated in FIG. 5. The shaft comprises a main shaft component 20 and is provided with a keyway 21 onto which a sprocket gear 22 may be fitted, the gear serving as a drive means to the rudder. Stop collars 23 and 24 which are usually found on the original shaft as well as the sprocket 22, will prevent the shaft from moving laterally within the pedestal casing. In some cases, enlarged hubs on the sprocket serve in lieu of separate collars. The main shaft is fitted at its terminus with a swivel made up of a female swivel part 30 and male swivel part 32, the latter of which has an ear 33 and is received within the slot 34 of the female swivel. The two swivel parts are pinned together for rocking motion by a pivot pin 36. A plunger 38, which is spring loaded, extends through the wall of the female swivel and will engage one of three detents 40, 41 or 42 in the tongue 33 of the male swivel. Attached to the male swivel is stub shaft 46 which is suitably threaded as at 47 for the reception of a securing nut 48 so that the hub of 49 of a wheel is suitably retained thereon.

In some cases, as for example with a pedestal that has a rack and pinion drive, it is not feasible to replace the entire shafting as discussed above. Accordingly the existing stub shaft will have threadingly secured thereto, in lieu of a wheel hub, a swivel part 30'. In all other respects, the arrangement is similar.

Figure 2:
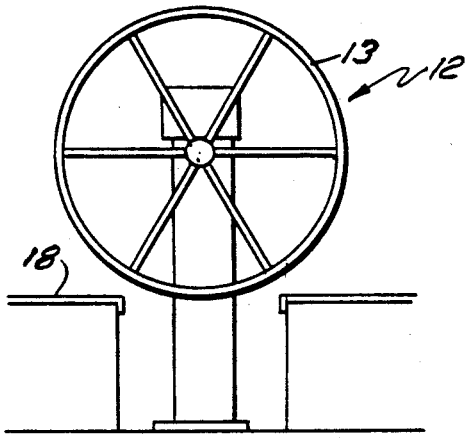
FIG. 2 is an illustrative view looking forward at a steering pedestal mounted in the cockpit of a small boat illustrating the fact that a seat locker may not be lifted as it would interfere with the wheel.
Figure 3:
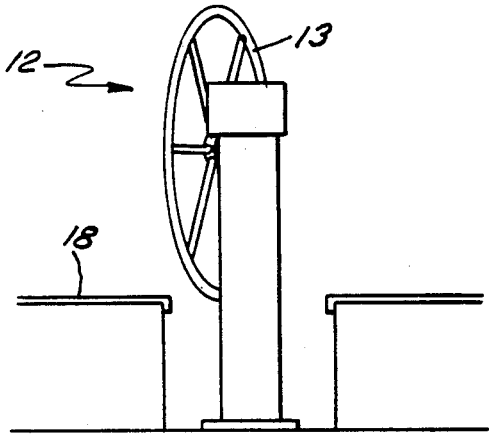
FIG. 3 and 4 are respectively elevational views looking aft and a top view showing a wheel pivoted in accordance with the construction of the invention.
Figure 4:
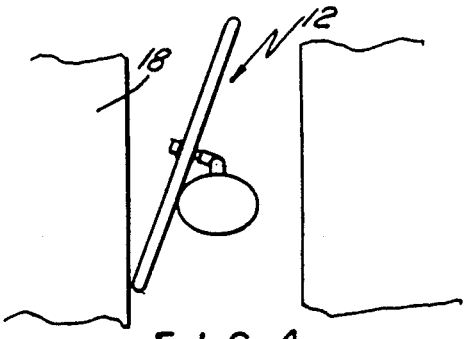

As illustrated in FIGS. 2, 3 and 4, it will be seen that while the wheel is normally athwartships, when it is desired to have access to a cockpit seat or to gain walking access fore and aft of the wheel, the plunger 38 may be pulled and the wheel rocked as seen in FIG. 4 about an arc of approximately 70° and then secured in position in either the detent 41 or 42. It will of course be understood that while this motion is being created that the shaft should be properly aligned so that the slot 34 in the female swivel is substantially horizontal.

With reference to FIGS. 8–11, there is illustrated the preferred form of swivel which has proven to be satisfactory in all regards. To this end, the female swivel part 30' has in this case been designated as the portion which will have the wheel affixed thereto and onto the shaft portion 46', which is fitted with two keyways 50, 51 that are at right angles to each other, and will have a threaded end portion 47' with a reception of the securing knot for the steering wheel. Two keyways 50 and 51' are necessary so that the steering wheel can be circularly oriented relative to the shaft. For example, the pedestal may be fitted with pods which hold speed, depth or other navigational-type instruments and in order to have the area between the spokes thereof clear the pods when rocked, the orientation can be varied by the utilization of the two keyways. Thus, the spokes of the steering wheel will not interfere with the swiveling thereof as the pods will go into the open spaces between the spokes.

The outer wall of the female swivel has a plunger 38' whose shaft 39 has a enlarged threaded portion **39*a* that engages a threaded bore in the wall of the female portion and whose end 39*b* is conical. To provide a tension on the threads, a nut 55 is received in a threaded counterbore 56 and a helical spring 57 is received about the plunger shaft 39 butting up against a shoulder thereon and the nut. On the other ear of the female swivel part is located a threaded bore 60 into which is fitted a threaded screw 61 having an axial partial bore 62 into which a spring is fitted that engages a ball 63** that is pressed outwardly.

The male swivel part 30' has a tongue, 33', that is fitted with three conical bores 40', 41', 42' and is also fitted with a plastic bearing plate 66 which has a cutout portion which extends throughout the arcuate area embracing the three conical recesses 40', 41', 42'. On the other side of the tongue 33' are a plurality of roller bearings 68 arranged in an arcuate fashion and at the end of the sector embracing the rollers are stop pins 69, **69*a* while intermediate the arc are three detents 70, 71 and 72 into which the detent ball 63** may engage to assist initially in orienting the swivel to one of its three positions before engaging the locking plunger.

In essence, this version of the swivel joint provides not only a joint which will readily be able to rock once the locking plunger is removed into a selected position and then relocked, but also one in which the weather is sealed from the joint by virtue of the plastic plates such as 66, **66*a* that are located on the male tongue 33'** of the swivel parts and encapsulate effectively the working areas keeping water thereout and particularly keeping water out of the roller bearing surface which provides ease of swivel operation.

I claim:

1. In combination an upright hollow yacht steering pedestal having a column portion, and a base portion affixed to the cockpit deck of a boat, the pedestal column portion having a shaft rotatively mounted in and transverse to the pedestal column, a rudder shaft drive means affixed to the shaft within the pedestal column, said shaft having a swivel joint located outside the column and a wheel mounted at the terminus of the swivel joint.

2. A replacement shaft for a yacht steering pedestal comprising a main shaft section for receiving a drive means on said section and adapted to be mounted in the pedestal, one half of a swivel joint affixed to a remote end of the shaft from the drive means and a stub shaft section having a mating half of a swivel joint, the remote end of the stub shaft adapted to receive a steering wheel.

3. In a boat having an upright pedestal steering column that is affixed to the cockpit deck of a boat, a substantially horizontal shaft rotatively mounted in and transverse to the pedestal, said shaft having rudder drive means affixed to the shaft, means including a swivel joint supporting a steering wheel on said shaft for swinging movement from normal operative position normal to the axis of the shaft to a displaced position, latch means coupled to the swivel joint for releasably retaining the wheel in normal operative position.

4. A combination as in claim 1 wherein said swivel joint has a female portion with a slot and a male portion with a tongue and means are provided for releasably locking the swivel joint in at least two positions.

5. A combination as in claim 1 wherein releasable locking means are provided for locking the swivel joint in at least two positions, which locking means have a conical pin engaging a conical recess in a corresponding part.

* * * * *